US010615512B2

(12) United States Patent
You et al.

(10) Patent No.: US 10,615,512 B2
(45) Date of Patent: Apr. 7, 2020

(54) COMMUNICATION DEVICE

(71) Applicant: Wistron NeWeb Corp., Hsinchu (TW)

(72) Inventors: Shang-Sian You, Hsinchu (TW); Huang-Tse Peng, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 156 days.

(21) Appl. No.: 16/019,769

(22) Filed: Jun. 27, 2018

(65) Prior Publication Data

US 2019/0386399 A1 Dec. 19, 2019

(30) Foreign Application Priority Data

Jun. 13, 2018 (TW) ..... 107120353 A

(51) Int. Cl.

| | |
|---|---|
| ***H01Q 21/06*** | (2006.01) |
| ***H01Q 25/00*** | (2006.01) |
| ***H01Q 19/10*** | (2006.01) |
| ***H01Q 5/48*** | (2015.01) |
| *H01Q 21/24* | (2006.01) |

(52) U.S. Cl.

CPC ..... *H01Q 21/062* (2013.01); *H01Q 5/48* (2015.01); *H01Q 19/108* (2013.01); *H01Q 25/001* (2013.01); *H01Q 21/24* (2013.01)

(58) Field of Classification Search

CPC ..... H01Q 19/108; H01Q 21/062; H01Q 5/48; H01Q 25/001; H01Q 21/24

See application file for complete search history.

(56) References Cited

U.S. PATENT DOCUMENTS

| | | | | |
|---|---|---|---|---|
| 4,740,793 A * | 4/1988 | Wolfson | H01Q 9/065 | 343/700 MS |
| 5,508,706 A * | 4/1996 | Tsou | B60Q 1/0023 | 342/110 |
| 6,396,449 B1 * | 5/2002 | Osterhues | H01Q 3/44 | 343/754 |
| 8,217,847 B2 * | 7/2012 | Sotelo | H01Q 3/46 | 343/700 MS |
| 8,462,071 B1 * | 6/2013 | Rudish | H01Q 1/523 | 343/797 |
| 2010/0171675 A1 * | 7/2010 | Borja | H01Q 1/38 | 343/798 |

* cited by examiner

*Primary Examiner* — Graham P Smith
*Assistant Examiner* — Jae K Kim
(74) *Attorney, Agent, or Firm* — McClure, Qualey & Rodack, LLP

(57) ABSTRACT

A communication device includes a first antenna group, a second antenna group, and a metal partition plane. The metal partition plane is positioned between the first antenna group and the second antenna group. The first antenna group includes four antenna elements. The second antenna group includes eight antenna elements. Two antenna elements of the first antenna group and four antenna elements of the second antenna group each have a first polarization direction. The other two antenna elements of the first antenna group and the other four antenna elements of the second antenna group each have a second polarization direction. The second polarization direction is different from the first polarization direction.

19 Claims, 16 Drawing Sheets

COMMUNICATION DEVICE

CROSS REFERENCE TO RELATED APPLICATIONS

This application claims priority of Taiwan Patent Application No. 107120353 filed on Jun. 13, 2018, the entirety of which is incorporated by reference herein.

BACKGROUND OF THE INVENTION

Field of the Invention

The disclosure generally relates to a communication device, and more particularly, to an omnidirectional communication device with high isolation.

Description of the Related Art

With the advancements being made in mobile communication technology, mobile devices such as portable computers, mobile phones, multimedia players, and other hybrid functional portable electronic devices have become more common. To satisfy consumer demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

Wireless access points are indispensable elements for mobile devices in a room to connect to the Internet at a high speed. However, since an indoor environment can experience serious signal reflection and multipath fading, wireless access points should process signals from a variety of transmission directions simultaneously. Accordingly, it has become a critical challenge for antenna designers to design an omnidirectional communication device with high isolation in the limited space of a wireless access point.

BRIEF SUMMARY OF THE INVENTION

In an exemplary embodiment, the invention is directed to a communication device including a first antenna group, a second antenna group, and a metal partition plane. The first antenna group includes a first antenna element, a second antenna element, a third antenna element, and a fourth antenna element. The second antenna element is disposed opposite to the first antenna element. The fourth antenna element is disposed opposite to the third antenna element. The second antenna group includes a fifth antenna element, a sixth antenna element, a seventh antenna element, an eighth antenna element, a ninth antenna element, a tenth antenna element, an eleventh antenna element, and a twelfth antenna element. The sixth antenna element is disposed adjacent to the fifth antenna element. The seventh antenna element is disposed adjacent to the sixth antenna element and opposite to the fifth antenna element. The eighth antenna element is disposed adjacent to the fifth antenna element and the seventh antenna element and opposite to the sixth antenna element. The eleventh antenna element is disposed opposite to the ninth antenna element. The twelfth antenna element is disposed opposite to the tenth antenna element. The fifth antenna element, the sixth antenna element, the seventh antenna element, and the eighth antenna element are interleaved with the ninth antenna element, the tenth antenna element, the eleventh antenna element, and the twelfth antenna element. The metal partition plane is positioned between the first antenna group and the second antenna group. Each of the first antenna element, the second antenna element, the fifth antenna element, the sixth antenna element, the seventh antenna element, and the eighth antenna element has a first polarization direction. Each of the third antenna element, the fourth antenna element, the ninth antenna element, the tenth antenna element, the eleventh antenna element, and the twelfth antenna element has a second polarization direction. The second polarization direction is different from the first polarization direction.

In some embodiments, the second polarization direction is perpendicular to the first polarization direction.

In some embodiments, the first polarization direction is parallel to the metal partition plane, and the second polarization direction is perpendicular to the metal partition plane.

In some embodiments, the first antenna group covers a first frequency band from 2400 MHz to 2500 MHz, and a second frequency band from 5150 MHz to 5850 MHz.

In some embodiments, the second antenna group covers a second frequency band from 5150 MHz to 5850 MHz.

In some embodiments, the first antenna element and the second antenna element are interleaved with the third antenna element and the fourth antenna element.

In some embodiments, the length of the metal partition plane is longer than or equal to 0.5 wavelength of the lowest frequency of the first frequency band.

In some embodiments, the distance between the first antenna element and the second antenna element is longer than or equal to 0.125 wavelength of the lowest frequency of the first frequency band.

In some embodiments, the distance between the third antenna element and the fourth antenna element is longer than or equal to 0.25 wavelength of the lowest frequency of the first frequency band.

In some embodiments, the distance between any adjacent two of the fifth antenna element, the sixth antenna element, the seventh antenna element, and the eighth antenna element is longer than or equal to 0.125 wavelength of the lowest frequency of the second frequency band.

In some embodiments, the distance between any adjacent two of the ninth antenna element, the tenth antenna element, the eleventh antenna element, and the twelfth antenna element is longer than or equal to 0.25 wavelength of the lowest frequency of the second frequency band.

In some embodiments, the distance between the metal partition plane and each of the first antenna element, the second antenna element, the fifth antenna element, the sixth antenna element, the seventh antenna element, and the eighth antenna element is longer than or equal to 0.125 wavelength of the highest frequency of the second frequency band.

In some embodiments, the third antenna element and the fourth antenna element have a first vertical projection on the metal partition plane, and the ninth antenna element, the tenth antenna element, the eleventh antenna element, and the twelfth antenna element have a second vertical projection on the metal partition plane. The second vertical projection at least partially overlaps the first vertical projection.

In some embodiments, there is a first distance between the metal partition plane and each of the third antenna element and the fourth antenna element, and there is a second distance between the metal partition plane and each of the ninth antenna element, the tenth antenna element, the eleventh antenna element, and the twelfth antenna element. The sum of the first distance and the second distance is longer than or equal to 1 wavelength of the lowest frequency of the second frequency band.

In some embodiments, the third antenna element and the fourth antenna element have a first vertical projection on the metal partition plane, and the ninth antenna element, the tenth antenna element, the eleventh antenna element, and the twelfth antenna element have a second vertical projection on the metal partition plane. The second vertical projection does not overlap the first vertical projection at all.

In some embodiments, there is a first distance between the metal partition plane and each of the third antenna element and the fourth antenna element, and there is a second distance between the metal partition plane and each of the ninth antenna element, the tenth antenna element, the eleventh antenna element, and the twelfth antenna element. The sum of the first distance and the second distance is longer than or equal to 0.5 wavelength of the lowest frequency of the second frequency band.

In some embodiments, the metal partition plane has one or more slots.

In some embodiments, the length of each of the slots is equal to 0.25 wavelength of the lowest frequency of the second frequency band.

In some embodiments, the communication device further includes a metal reflective plane. The second antenna group is positioned between the metal partition plane and the metal reflective plane.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
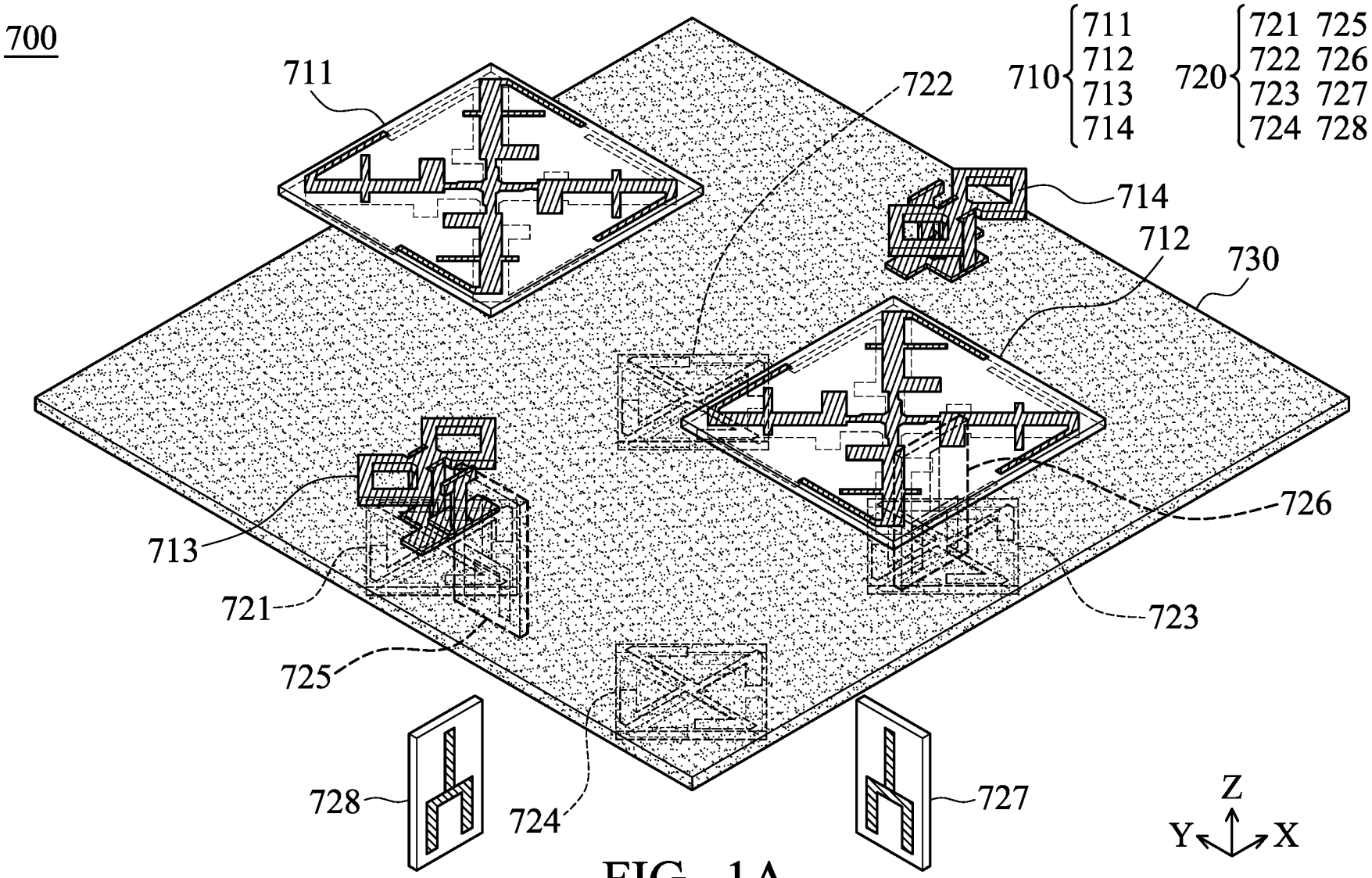
FIG. 1A is a perspective view of a communication device according to an embodiment of the invention.
Figure 1B:
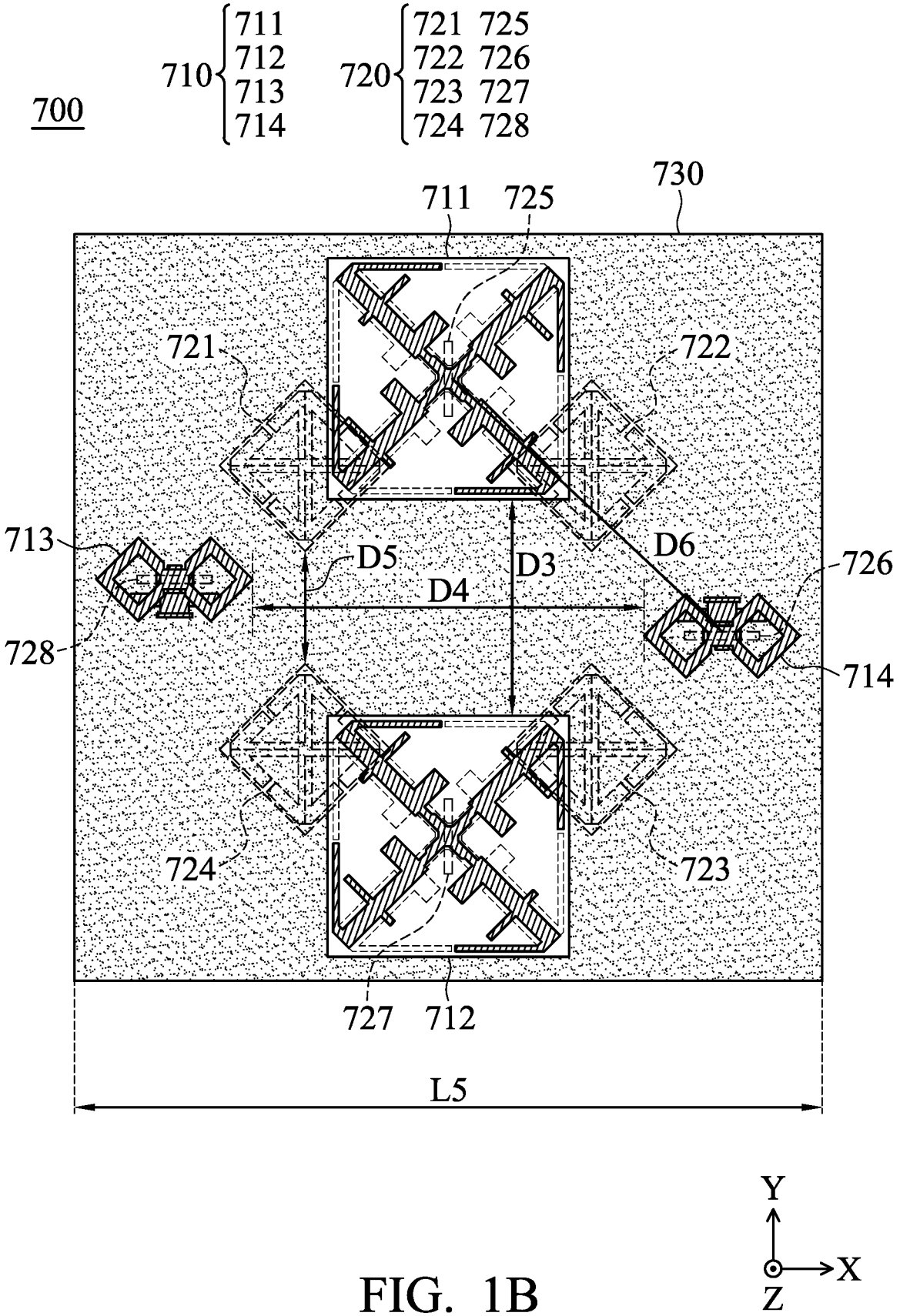
FIG. 1B is a top view of a communication device according to an embodiment of the invention.
Figure 1C:
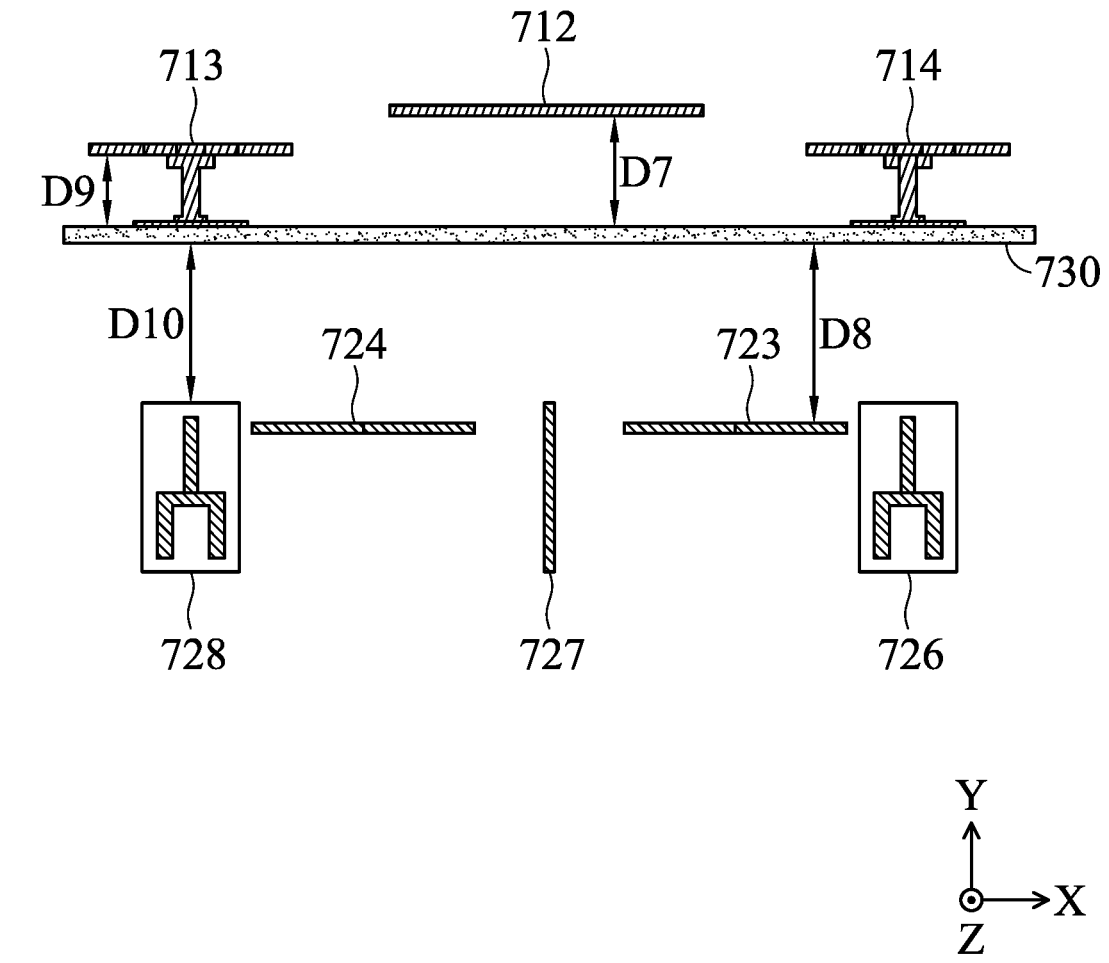
FIG. 1C is a side view of a communication device according to an embodiment of the invention.

FIG. 1A is a perspective view of a communication device 700 according to an embodiment of the invention. FIG. 1B is a top view of the communication device 700 according to an embodiment of the invention. FIG. 1C is a side view of the communication device 700 according to an embodiment of the invention. Please refer to FIG. 1A, FIG. 1B, and FIG. 1C together. The communication device 700 may be applied to a wireless access point. In the embodiment of FIG. 1A, FIG. 1B, and FIG. 1C, the communication device 700 includes a first antenna group 710, a second antenna group 720, and a metal partition plane 730. The metal partition plane 730 is positioned between the first antenna group 710 and the second antenna group 720. The metal partition plane 730 is configured to completely separate the first antenna group 710 from the second antenna group 720. For example, the first antenna group 710 may be disposed above the metal partition plane 730, and the second antenna group 720 may be disposed below the metal partition plane 730, but they are not limited thereto. The metal partition plane 730 may have any shape, such as a square shape, a circular shape, a triangular shape, an elliptical shape, a trapezoidal shape, a rectangular shape, or an irregular shape.

The first antenna group 710 includes a first antenna element 711, a second antenna element 712, a third antenna element 713, and a fourth antenna element 714. The second antenna group 720 includes a fifth antenna element 721, a sixth antenna element 722, a seventh antenna element 723, an eighth antenna element 724, a ninth antenna element 725, a tenth antenna element 726, an eleventh antenna element 727, and a twelfth antenna element 728. The shapes and types of the aforementioned antenna elements are not limited in the invention. For example, any of the aforementioned antenna elements may be a monopole antenna, a dipole antenna, a helical antenna, a patch antenna, a loop antenna, or a chip antenna, but it is not limited thereto.

Each of the first antenna element 711, the second antenna element 712, the fifth antenna element 721, the sixth antenna element 722, the seventh antenna element 723, and the eighth antenna element 724 has a first polarization direction. Each of the third antenna element 713, the fourth antenna element 714, the ninth antenna element 725, the tenth antenna element 726, the eleventh antenna element 727, and the twelfth antenna element 728 has a second polarization direction. The second polarization direction is different from the first polarization direction. In some embodiments, the second polarization direction is perpendicular to the first polarization direction. For example, the first polarization direction may be a horizontal polarization direction which is parallel to the metal partition plane 730 (or parallel to the XY-plane), and the second polarization direction may be a vertical polarization direction which is perpendicular to the metal partition plane 730 (or perpendicular to the Z-axis).

Among the first antenna group 710, the first antenna element 711 and the second antenna element 712 are interleaved with the third antenna element 713 and the fourth antenna element 714. Among the second antenna group 720, the fifth antenna element 721, the sixth antenna element 722, the seventh antenna element 723, and the eighth antenna element 724 are interleaved with the ninth antenna element 725, the tenth antenna element 726, the eleventh antenna element 727, and the twelfth antenna element 728. That is, regardless of the first antenna group 710 or the second antenna group 720, any antenna element having the first polarization direction may be positioned between two antenna elements having the second polarization direction, and any antenna element having the second polarization direction may be positioned between two antenna elements having the first polarization direction. Such a design can increase the isolation between adjacent antenna elements and enhance the antenna polarization diversity of the communication device 700.

In some embodiments, the first antenna element 711, the second antenna element 712, the fifth antenna element 721, the sixth antenna element 722, the seventh antenna element 723, the eighth antenna element 724, the ninth antenna element 725, the tenth antenna element 726, the eleventh antenna element 727, and the twelfth antenna element 728 are all PCB (Printed Circuit Board) antennas, which are fixed onto the metal partition plane 730 by using plastic supporting elements (not shown). In some embodiments, the third antenna element 713 and the fourth antenna element 714 are ironware antennas, which are directly fixed onto the metal partition plane 730 by using screws. Specifically, the third antenna element 713 and the fourth antenna element 714 have a first vertical projection on the metal partition plane 730, and the ninth antenna element 725, the tenth antenna element 726, the eleventh antenna element 727, and the twelfth antenna element 728 have a second vertical projection on the metal partition plane 730. The second vertical projection may at least partially overlap the first vertical projection. For example, the vertical projection of the third antenna element 713 may at least partially overlap the vertical projection of the twelfth antenna element 728, and the vertical projection of the fourth antenna element 714 may at least partially overlap the vertical projection of the tenth antenna element 726, but they are not limited thereto.

In some embodiments, each antenna element of the first antenna group 710 covers a first frequency band from 2400 MHz to 2500 MHz, and a second frequency band from 5150 MHz to 5850 MHz. In addition, each antenna element of the second antenna group 720 covers the second frequency band from 5150 MHz to 5850 MHz. Therefore, the communication device 700 can support at least the dual-band operations of WLAN (Wireless Local Area Network) 2.4 GHz/5 GHz. According to practical measurements, the isolation between the first antenna group 710 and the second antenna group 720 is 40 dB or higher within the aforementioned second frequency band, and the isolation between any two adjacent antenna elements in the same antenna group is 20 dB or higher. Furthermore, both the first antenna group 710 and the second antenna group 720 have almost omnidirectional radiation patterns. The above performance parameters can meet the requirements of practical applications of general mobile communication.

In some embodiments, the element sizes of the communication device 700 are as follows. The length L5 of the metal partition plane 730 (e.g., the length of each side of the square metal partition plane 730) may be longer than or equal to 0.5 wavelength ($\lambda/2$) of the lowest frequency of the aforementioned first frequency band. The distance D3 between the first antenna element 711 and the second antenna element 712 may be longer than or equal to 0.125 wavelength ($\lambda/8$) of the lowest frequency of the aforementioned first frequency band. The distance D4 between the third antenna element 713 and the fourth antenna element 714 may be longer than or equal to 0.25 wavelength ($\lambda/4$) of the lowest frequency of the aforementioned first frequency band. The distance D5 between any adjacent two of the fifth antenna element 721, the sixth antenna element 722, the seventh antenna element 723, and the eighth antenna element 724 may be longer than or equal to 0.125 wavelength ($\lambda/8$) of the lowest frequency of the aforementioned second frequency band. The distance D6 between any adjacent two of the ninth antenna element 725, the tenth antenna element 726, the eleventh antenna element 727, and the twelfth antenna element 728 may be longer than or equal to 0.25 wavelength ($\lambda/4$) of the lowest frequency of the aforementioned second frequency band. The distance D7 between the metal partition plane 730 and each of the first antenna element 711 and the second antenna element 712 may be longer than or equal to 0.125 wavelength ($\lambda/8$) of the highest frequency of the aforementioned second frequency band. The distance D8 between the metal partition plane 730 and each of the fifth antenna element 721, the sixth antenna element 722, the seventh antenna element 723, and the eighth antenna element 724 may be longer than or equal to 0.125 wavelength ($\lambda/8$) of the highest frequency of the aforementioned second frequency band. There is a first distance D9 between the metal partition plane 730 and each of the third antenna element 713 and the fourth antenna element 714. There is a second distance D10 between the metal partition plane 730 and each of the ninth antenna element 725, the tenth antenna element 726, the eleventh antenna element 727, and the twelfth antenna element 728. The sum of the first distance D9 and the second distance D10 may be longer than or equal to 1 wavelength ($\lambda$) of the lowest frequency of the aforementioned second frequency band. The above ranges of sizes and distances are calculated and obtained according to many experiment results, and they help to optimize the isolation and radiation pattern of the communication device 700.

Figure 2A:
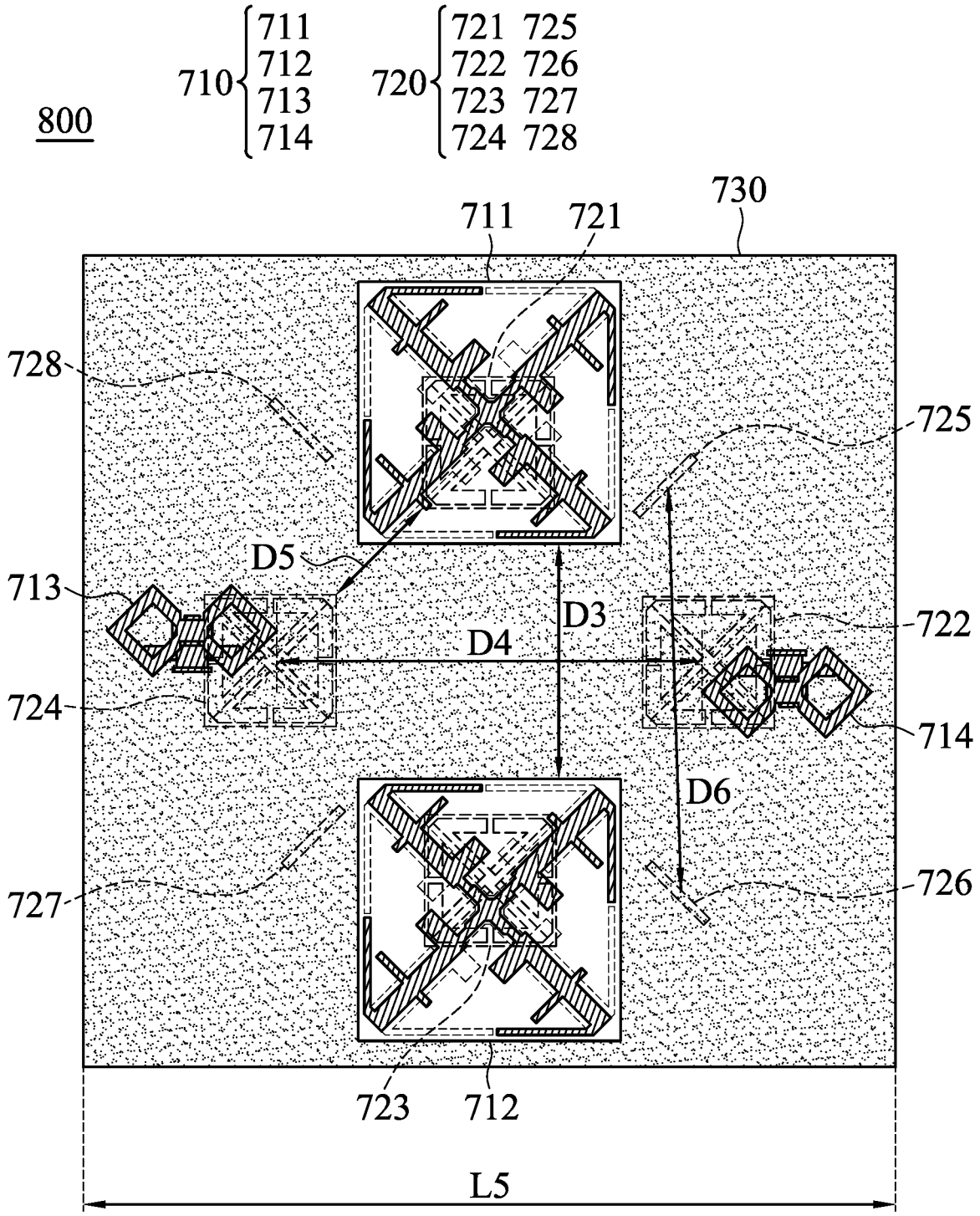
FIG. 2A is a top view of a communication device according to an embodiment of the invention.
Figure 2A:
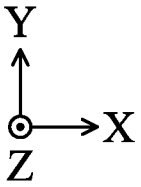

FIG. 2A is a top view of a communication device 800 according to an embodiment of the invention. FIG. 2A is similar to FIG. 1B. In the embodiment of FIG. 2A, the second antenna group 720 is slightly rotated with respect to the central point of the communication device 800. Specifically, the third antenna element 713 and the fourth antenna element 714 have a first vertical projection on the metal partition plane 730, and the ninth antenna element 725, the tenth antenna element 726, the eleventh antenna element 727, and the twelfth antenna element 728 have a second vertical projection on the metal partition plane 730. The second vertical projection may not overlap the first vertical projection at all. According to practical measurements, such a interleaving design can reduce the interference between the first antenna group 710 and the second antenna group 720 in the second polarization direction, thereby minimizing the size of the communication device 800 (especially for the height on the Z-axis). Please refer to FIG. 1C again. There is a first distance D9 between the metal partition plane 730 and each of the third antenna element 713 and the fourth antenna element 714. There is a second distance D10 between the metal partition plane 730 and each of the ninth antenna element 725, the tenth antenna element 726, the eleventh antenna element 727, and the twelfth antenna element 728. If the interleaving design of FIG. 2A is used, the sum of the first distance D9 and the second distance D10 may be merely longer than or equal to 0.5 wavelength (λ/2) of the lowest frequency of the second frequency band of the communication device 800 (reduced by 50% or more). Other features of the communication device 800 of FIG. 2A are similar to those of the communication device 700 of FIG. 1A, FIG. 1B, and FIG. 1C. Therefore, the two embodiments can achieve similar levels of performance.

Figure 2B:
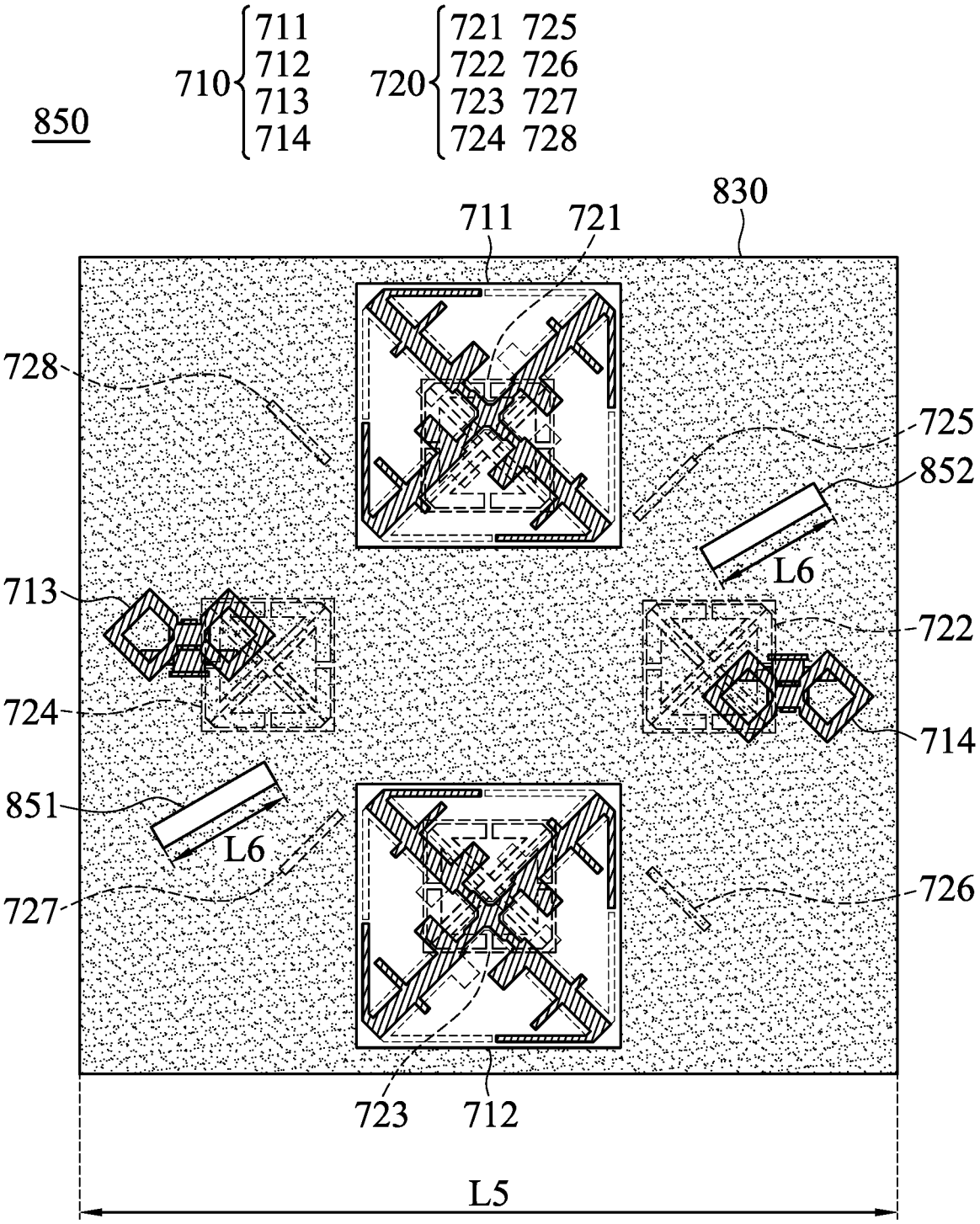
FIG. 2B is a top view of a communication device according to an embodiment of the invention.
Figure 2B:
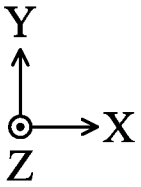

FIG. 2B is a top view of a communication device 850 according to an embodiment of the invention. FIG. 2B is similar to FIG. 2A. In the embodiment of FIG. 2B, a metal partition plane 830 of the communication device 850 has one or more slots 851 and 852. The length L6 of each of the slots 851 and 852 may be substantially equal to 0.25 wavelength (λ/4) of the lowest frequency of the second frequency band of the communication device 850. For example, the slot 851 may be positioned between the vertical projection of the third antenna element 713 and the vertical projection of the eleventh antenna element 727, and the slot 852 may be positioned between the vertical projection of the fourth antenna element 714 and the vertical projection of the ninth antenna element 725, but they are not limited thereto. According to practical measurements, such a slot design can reduce the interference between the first antenna group 710 and the second antenna group 720 in the second polarization direction, thereby minimizing the size of the communication device 850 (especially for the height on the Z-axis). It should be understood that although two slots 851 and 852 are displayed in FIG. 2B, in other embodiments, the metal partition plane 830 may have more or fewer slots in response to different requirements. Other features of the communication device 850 of FIG. 2B are similar to those of the communication device 800 of FIG. 2A. Therefore, the two embodiments can achieve similar levels of performance.

Figure 3:
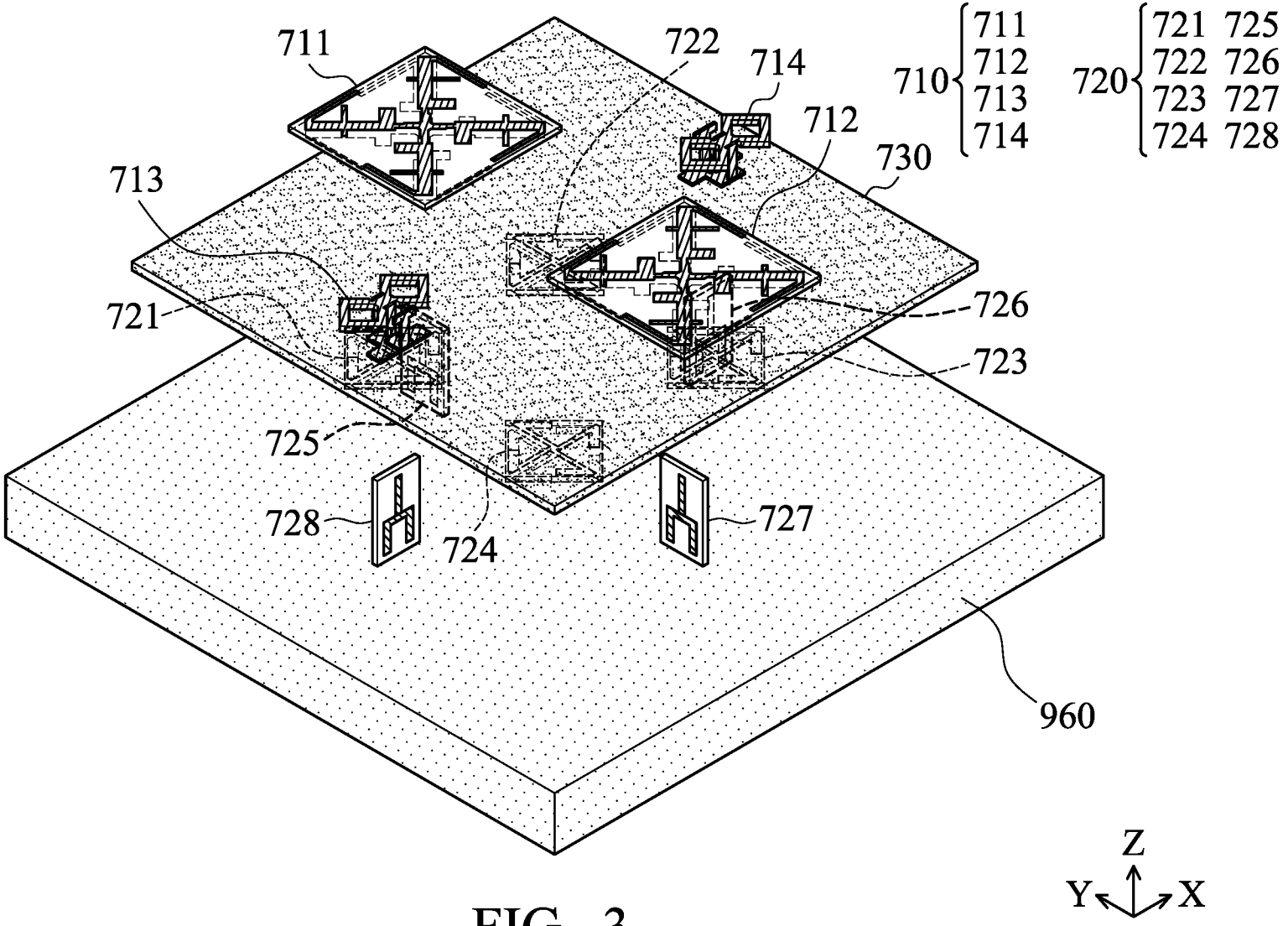
FIG. 3 is a perspective view of a communication device according to an embodiment of the invention.

FIG. 3 is a perspective view of a communication device 900 according to an embodiment of the invention. FIG. 3 is similar to FIG. 1A. In the embodiment of FIG. 3, the communication device 900 further includes a metal reflective plane 960, which is adjacent to the second antenna group 720. It should be noted that the term "adjacent" or "close" over the disclosure means that the distance (spacing) between two corresponding elements is smaller than a predetermined distance (e.g., 10 mm or the shorter), or means that the two corresponding elements directly touch each other (i.e., the aforementioned distance/spacing therebetween is reduced to 0). The second antenna group 720 is positioned between the metal partition plane 730 and the metal reflective plane 960. For example, the metal reflective plane 960 may be a metal housing of a wireless access point, but it is not limited thereto. According to practical measurements, such a reflective-plane design can reduce the interference between the first antenna group 710 and the second antenna group 720 in the second polarization direction, thereby minimizing the size of the communication device 900 (especially for the height on the Z-axis). Other features of the communication device 900 of FIG. 3 are similar to those of the communication device 700 of FIG. 1A, FIG. 1B, and FIG. 1C. Therefore, the two embodiments can achieve similar levels of performance.

The following embodiments will introduce the detailed structure of each antenna element having the first polarization direction. It should be noted that each of the first antenna element 721, the second antenna element 722, the fifth antenna element 721, the sixth antenna element 722, the seventh antenna element 723, and the eighth antenna element 724 is called as an "antenna system". The following design patterns of antenna systems are merely exemplary, rather than limitations of the invention.

Figure 4A:
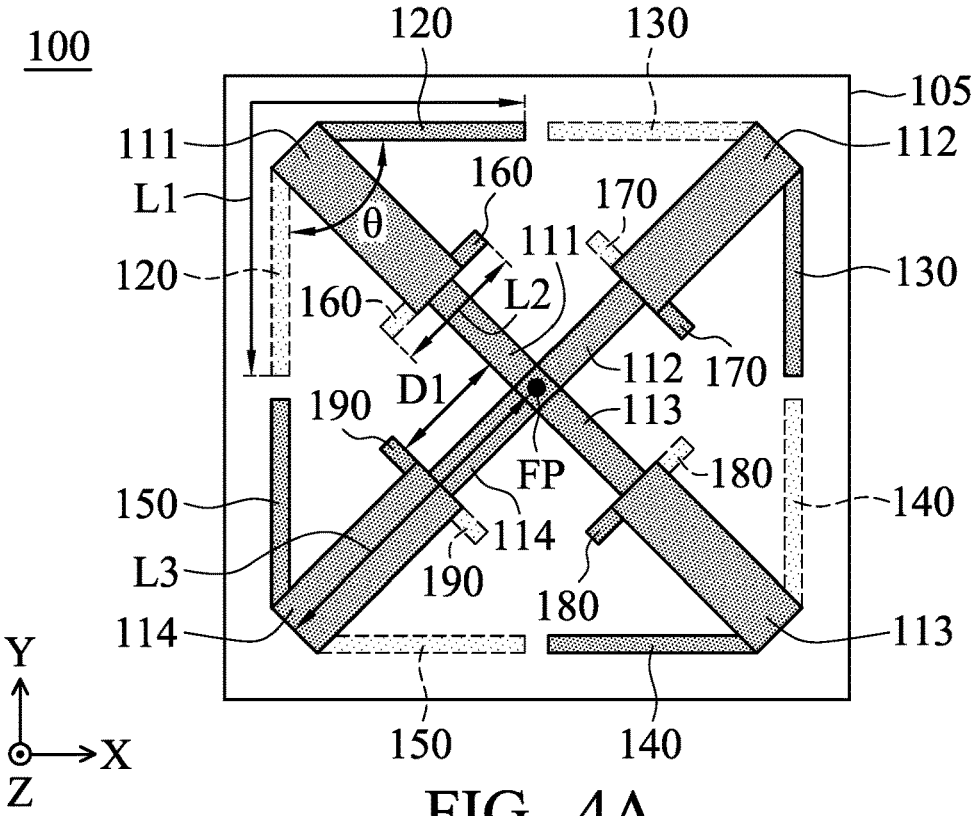
FIG. 4A is a diagram of an antenna system according to an embodiment of the invention.
Figure 4B:
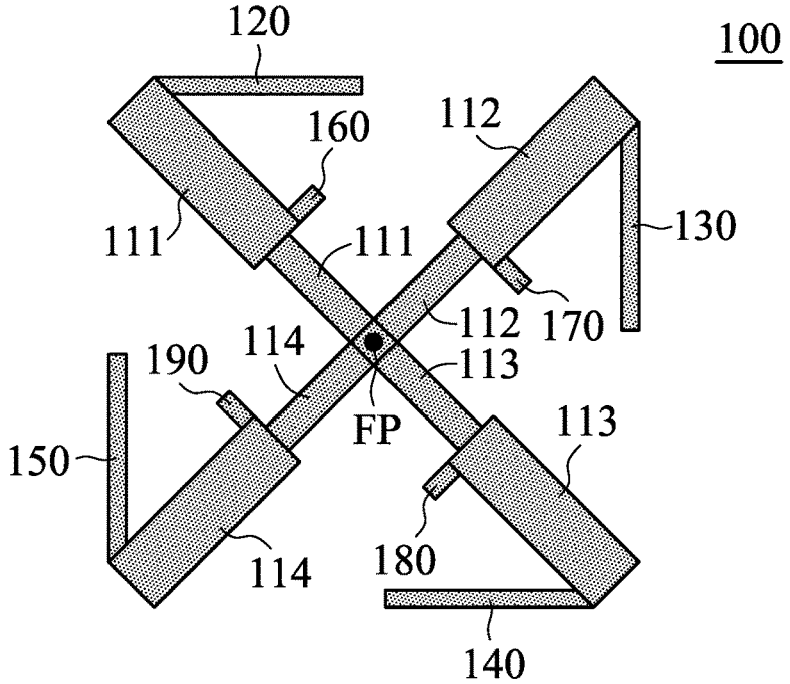
FIG. 4B is a diagram of an upper layer of an antenna system according to an embodiment of the invention.
Figure 4C:
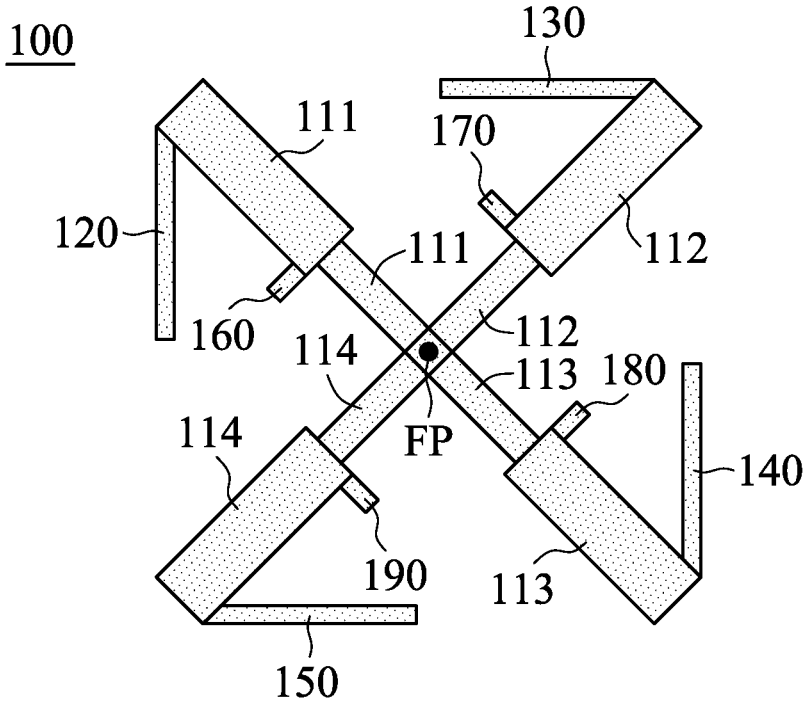
FIG. 4C is a diagram of a lower layer of an antenna system according to an embodiment of the invention.

FIG. 4A is a diagram of an antenna system 100 according to an embodiment of the invention. The antenna system 100 can be formed on an upper layer and a lower layer of a dielectric substrate 105. The dielectric substrate 105 may be a printed circuit board (PCB) or a flame retardant 4 (FR4) substrate. FIG. 4B is a diagram of an upper layer of the antenna system 100 according to an embodiment of the invention, that is, a partial antenna pattern disposed on the upper layer of the dielectric substrate 105 is displayed. FIG. 4C is a diagram of a lower layer of the antenna system 100 according to an embodiment of the invention, that is, another partial antenna pattern disposed on the lower layer of the dielectric substrate 105 is displayed. FIG. 4A is a combination of FIG. 4B and FIG. 4C. It should be noted that FIG. 4B is a top view of FIG. 4A, but FIG. 4C is a see-through view of the lower layer of the antenna pattern, instead of the back view of FIG. 4C (the difference between the see-through view and the back view is a 180-degree flip between the two). Please refer to FIG. 4A, FIG. 4B, and FIG. 4C together. The antenna system 100 may be applied to a wireless access point. In the embodiment of FIG. 4A, FIG. 4B, and FIG. 4C, the antenna system 100 includes a first transmission line 111, a second transmission line 112, a third transmission line 113, a fourth transmission line 114, a first dipole antenna 120, a second dipole antenna 130, a third dipole antenna 140, a fourth dipole antenna 150, a fifth dipole antenna 160, a sixth dipole antenna 170, a seventh dipole antenna 180, and an eighth dipole antenna 190. Each dipole antenna includes a radiator disposed on the upper layer of the dielectric substrate 105, and another radiator disposed on the lower layer of the dielectric substrate 105. Each transmission line includes transmission paths disposed at the corresponding positions on the upper layer and the lower layer of the dielectric substrate 105. Each of the radiators on the upper layer and the lower layer is positioned at an end of the corresponding transmission line. Each two corresponding radiators respectively disposed on the upper layer and the lower layer extend in different directions.

The antenna system 100 has a feeding point FP, which may be coupled to a radio frequency (RF) module (not shown). The RF module is configured to excite the antenna system 100. The first transmission line 111, the second transmission line 112, the third transmission line 113, the fourth transmission line 114, the first dipole antenna 120, the second dipole antenna 130, the third dipole antenna 140, the fourth dipole antenna 150, the fifth dipole antenna 160, the sixth dipole antenna 170, the seventh dipole antenna 180, and the eighth dipole antenna 190 are symmetrical with respect to the central feeding point FP. More specifically, the first transmission line 111, the first dipole antenna 120, and the fifth dipole antenna 160 can be grouped as a first communication unit; the second transmission line 112, the second dipole antenna 130, and the sixth dipole antenna 170 can be grouped as a second communication unit; the third transmission line 113, the third dipole antenna 140, and the seventh dipole antenna 180 can be grouped as a third communication unit; and the fourth transmission line 114, the fourth dipole antenna 150, and the eighth dipole antenna 190 can be grouped as a fourth communication unit. The four communication units may have the same structure, but arranged toward different directions in order to receive or transmit signals more omnidirectional. In other embodiments, the antenna system 100 may include fewer or more communication units depending on user demand.

Any adjacent two (e.g., the second transmission line 112 and the third transmission line 113, or the first transmission line 111 and the fourth transmission line 114) of the first transmission line 111, the second transmission line 112, the third transmission line 113, and the fourth transmission line 114 may be substantially perpendicular to each other. Accordingly, an arrangement of the first transmission line 111, the second transmission line 112, the third transmission line 113, and the fourth transmission line 114 may substantially have a cross-shape. The first dipole antenna 120 is coupled through the first transmission line 111 to the feeding point FP. The second dipole antenna 130 is coupled through the second transmission line 112 to the feeding point FP. The third dipole antenna 140 is coupled through the third transmission line 113 to the feeding point FP. The fourth dipole antenna 150 is coupled through the fourth transmission line 114 to the feeding point FP. In order to fine-tune the impedance matching, each of the aforementioned transmission lines may have an unequal-width structure. For example, each transmission line may include a wider portion and a narrower portion, where each of the wider portions may be connected directly to the corresponding dipole antenna, and each of the narrower portions may be connected directly to the feeding point FP. In alternative embodiments, each of the narrower portions can be connected directly to the corresponding dipole antenna, and each of the wider portions can be connected directly to the feeding point FP. In other embodiments, adjustments are made so that each of the aforementioned transmission lines has an equal-width structure.

Specifically, each of the first dipole antenna 120, the second dipole antenna 130, the third dipole antenna 140, and the fourth dipole antenna 150 includes a positive radiation branch and a negative radiation branch, which are respectively disposed on the upper layer and the lower layer of the dielectric substrate 105. The angle θ between the positive radiation branch and the negative radiation branch is less than 100 degrees. In some embodiments, the angle θ between the positive radiation branch and the negative radiation branch is substantially equal to 90 degrees, such that the arrangement of the first dipole antenna 120, the second dipole antenna 130, the third dipole antenna 140, and the fourth dipole antenna 150 substantially form a first square shape. The first transmission line 111, the second transmission line 112, the third transmission line 113, the fourth transmission line 114, the fifth dipole antenna 160, the sixth dipole antenna 170, the seventh dipole antenna 180, and the eighth dipole antenna 190 are surrounded by the first square shape.

The fifth dipole antenna 160 is coupled to the first transmission line 111, and is positioned between the first dipole antenna 120 and the feeding point FP. The sixth dipole antenna 170 is coupled to the second transmission line 112, and is positioned between the second dipole antenna 130 and the feeding point FP. The seventh dipole antenna 180 is coupled to the third transmission line 113, and is positioned between the third dipole antenna 140 and the feeding point FP. The eighth dipole antenna 190 is coupled to the fourth transmission line 114, and is positioned between the fourth dipole antenna 150 and the feeding point FP. Each of the fifth dipole antenna 160, the sixth dipole antenna 170, the seventh dipole antenna 180, and the eighth dipole antenna 190 is coupled to a central portion of each of the corresponding first transmission line 111, second transmission line 112, third transmission line 113, and fourth transmission line 114. The aforementioned central portion of each transmission line is at a junction between its wider portion and narrower portion.

Moreover, each of the fifth dipole antenna 160, the sixth dipole antenna 170, the seventh dipole antenna 180, and the eighth dipole antenna 190 includes two radiators respectively disposed on the upper layer and the lower layer, namely a positive radiation segment and a negative radiation segment, which are respectively disposed on the upper layer and the lower layer of the dielectric substrate 105. In some embodiments, the positive radiation segment and the negative radiation segment are substantially parallel to each other, or even linearly arranged, and they substantially extend in opposite directions, such that the arrangement of the fifth dipole antenna 160, the sixth dipole antenna 170, the seventh dipole antenna 180, and the eighth dipole antenna 190 substantially form a second square shape. The area of the second square shape is smaller than the area of the first square shape formed by the first dipole antenna 120, the second dipole antenna 130, the third dipole antenna 140, and the fourth dipole antenna 150. The second square shape is located within the first square shape. The feeding point FP can be positioned at a central point of the second square shape, the first square shape, or both of the above.

With respect to the antenna theory, each of the first dipole antenna 120, the second dipole antenna 130, the third dipole antenna 140, and the fourth dipole antenna 150 covers a low-frequency band, whereas each of the fifth dipole antenna 160, the sixth dipole antenna 170, the seventh dipole antenna 180, and the eighth dipole antenna 190 covers a high-frequency band. For example, the low-frequency band may be from about 2400 MHz to about 2500 MHz, and the high-frequency band may be from about 5150 MHz to about 5850 MHz.

It is worth noting that the entire size of the antenna system 100 can be greatly miniaturized comparing with conventional Alford loop antennas because of the appropriately designed and bent branches of each dipole antenna of the antenna system 100. Additionally, the entire area of the antenna system 100 is about 30% to 40% smaller than the conventional ones without affecting its performance, including the operating frequency bands and radiation efficiency. Therefore, the antenna system 100 has the advantages of small-size, wide-bandwidth, omnidirectional characteristics, and high antenna efficiency.

Figure 5A:
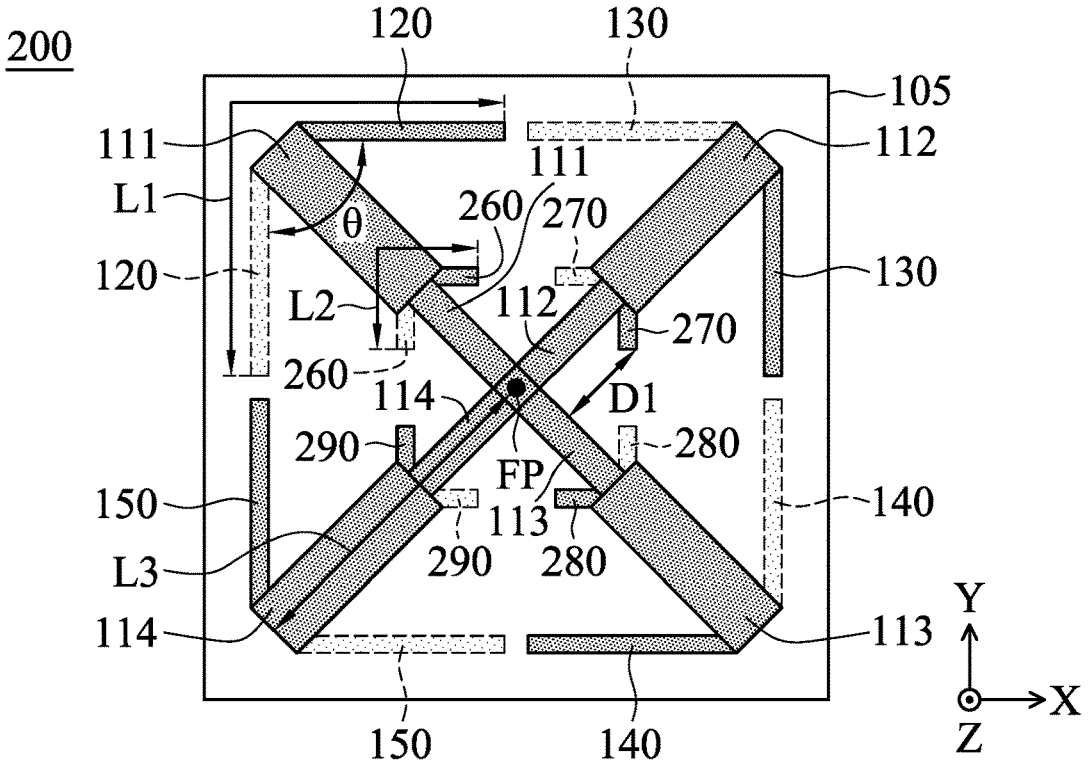
FIG. 5A is a diagram of an antenna system according to an embodiment of the invention.
Figure 5B:
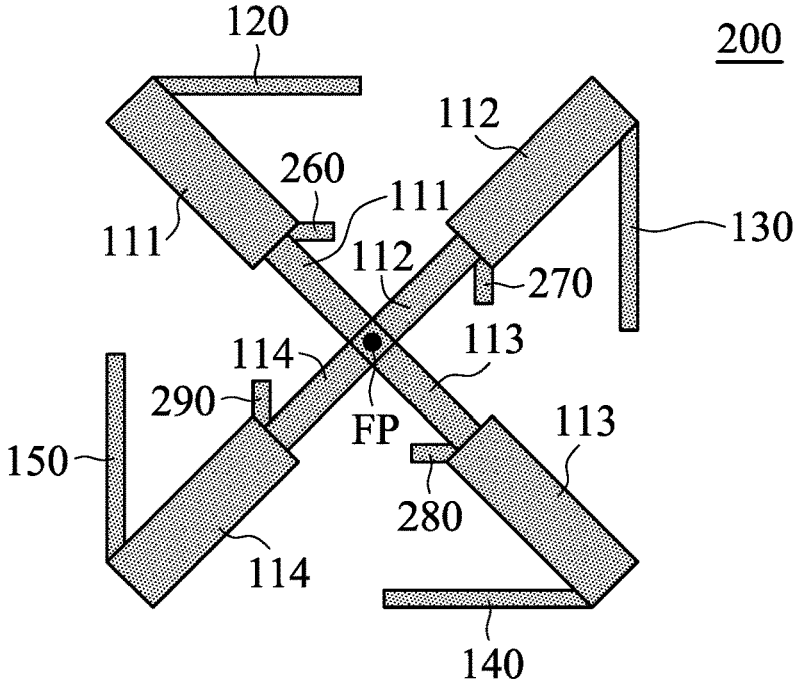
FIG. 5B is a diagram of an upper layer of an antenna system according to an embodiment of the invention.
Figure 5C:
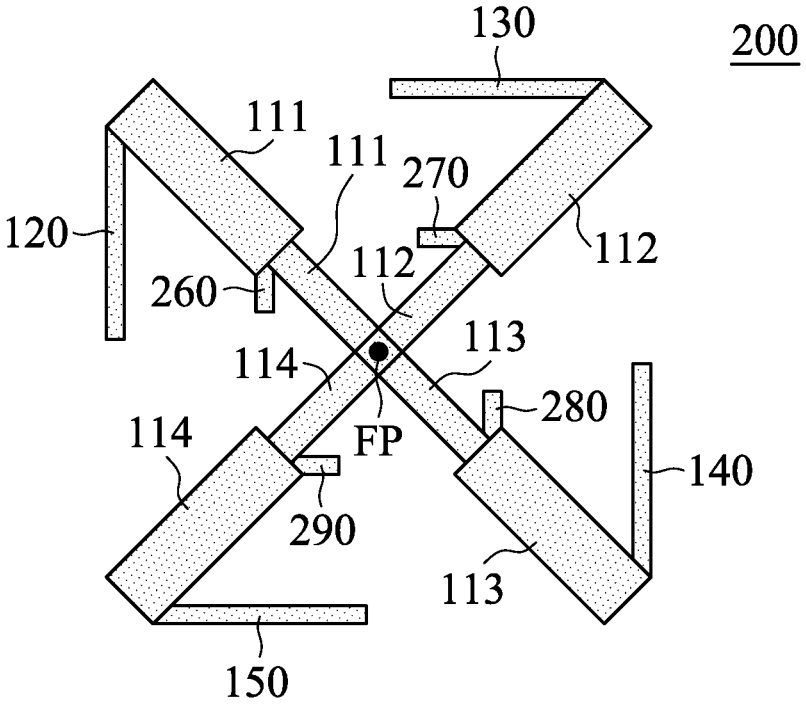
FIG. 5C is a diagram of a lower layer of an antenna system according to an embodiment of the invention.

FIG. 5A is a diagram of an antenna system 200 according to an embodiment of the invention. FIG. 5B is a diagram of an upper layer of the antenna system 200 according to an embodiment of the invention. FIG. 5C is a diagram of a lower layer of the antenna system 200 according to an embodiment of the invention. FIG. 5A, FIG. 5B, and FIG. 5C are similar to FIG. 4A, FIG. 4B, and FIG. 4C. In the embodiment of FIG. 5A, FIG. 5B, and FIG. 5C, a fifth dipole antenna 260, a sixth dipole antenna 270, a seventh dipole antenna 280, and an eighth dipole antenna 290 of the antenna system 200 extend in different directions. Specifically, each of the fifth dipole antenna 260, the sixth dipole antenna 270, the seventh dipole antenna 280, and the eighth dipole antenna 290 includes a positive radiation segment and a negative radiation segment (respectively disposed on the upper layer and the lower layer of the dielectric substrate 105). The positive radiation segment and the negative radiation segment are substantially perpendicular to each other, and they substantially extend away from the corresponding transmission line, such that the arrangement of the fifth dipole antenna 260, the sixth dipole antenna 270, the seventh dipole antenna 280, and the eighth dipole antenna 290 substantially form a third square shape. Note that the word "third" in the term "third square shape" does not mean that it has to be existing with a first and second square shape, the word "third" is merely used to distinguish from the "second square shape" of the previously introduced embodiment. The area of the third square shape is smaller than the area of the first square shape formed by the first dipole antenna 120, the second dipole antenna 130, the third dipole antenna 140, and the fourth dipole antenna 150. The third square shape is located within the first square shape. The feeding point FP can be positioned at a central point of the third square shape, the first square shape, or both of the above. The arrangement of the fifth dipole antenna 260, the sixth dipole antenna 270, the seventh dipole antenna 280, and the eighth dipole antenna 290 is configured to fine-tune the polarization direction of the antenna system 200 operating in the high-frequency band, without expanding the entire size of the antenna system 200. Other features of the antenna system 200 of FIG. 5A, FIG. 5B, and FIG. 5C are similar to those of the antenna system 100 of FIG. 4A, FIG. 4B, and FIG. 4C. Accordingly, the two embodiments can achieve similar levels of performance.

Figure 6A:
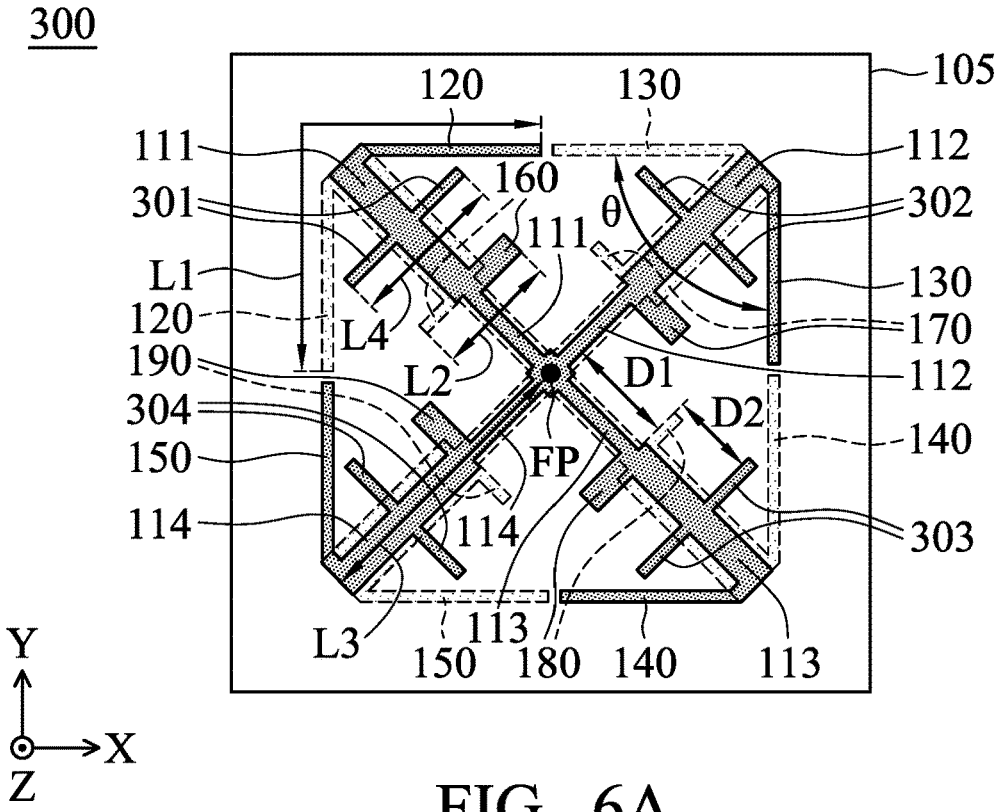
FIG. 6A is a diagram of an antenna system according to an embodiment of the invention.
Figure 6B:
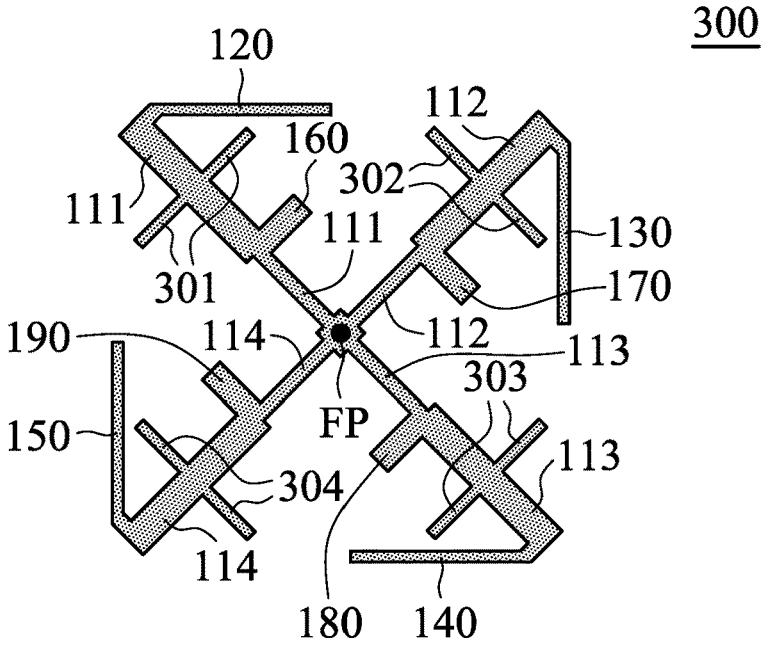
FIG. 6B is a diagram of an upper layer of an antenna system according to an embodiment of the invention.
Figure 6C:
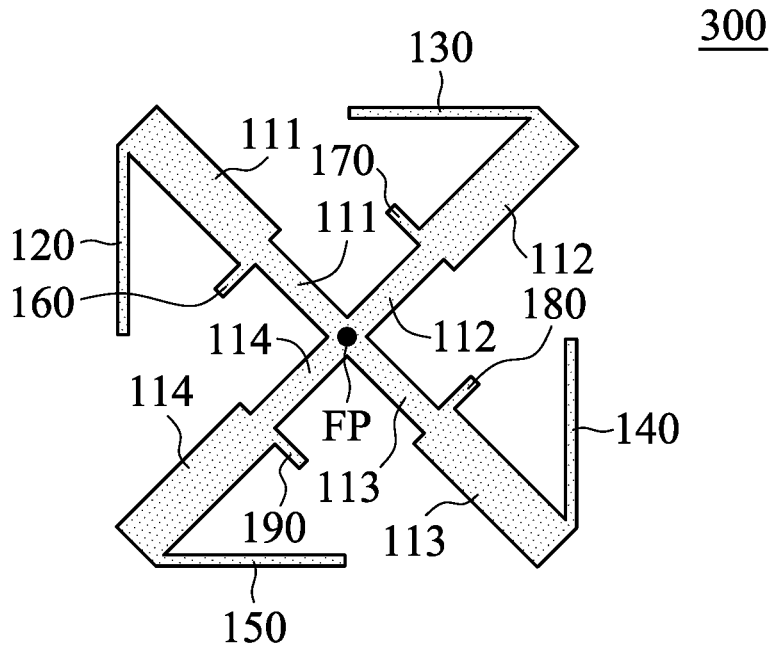
FIG. 6C is a diagram of a lower layer of an antenna system according to an embodiment of the invention.

FIG. 6A is a diagram of an antenna system 300 according to an embodiment of the invention. FIG. 6B is a diagram of an upper layer of the antenna system 300 according to an embodiment of the invention. FIG. 6C is a diagram of a lower layer of the antenna system 300 according to an embodiment of the invention. FIG. 6A, FIG. 6B, and FIG. 6C are similar to FIG. 4A, FIG. 4B, and FIG. 4C. In the embodiment of FIG. 6A, FIG. 6B, and FIG. 6C, the antenna system 300 further includes a first director 301, a second director 302, a third director 303, and a fourth director 304. The first director 301 is coupled to the first transmission line 111, and is positioned between the first dipole antenna 120 and the fifth dipole antenna 160. The second director 302 is coupled to the second transmission line 112, and is positioned between the second dipole antenna 130 and the sixth dipole antenna 170. The third director 303 is coupled to the third transmission line 113, and is positioned between the third dipole antenna 140 and the seventh dipole antenna 180. The fourth director 304 is coupled to the fourth transmission line 114, and is positioned between the fourth dipole antenna 150 and the eighth dipole antenna 190. Specifically, each of the first director 301, the second director 302, the third director 303, and the fourth director 304 includes a positive extension branch and a negative extension branch (both disposed on the upper layer of the dielectric substrate 105, or both disposed on the lower layer of the dielectric substrate 105). The positive extension branch and the negative extension branch are substantially parallel to each other, or even linearly arranged, and they substantially extend in opposite directions. Each of the first director 301, the second director 302, the third director 303, and the fourth director 304 may be substantially parallel to each of the corresponding fifth dipole antenna 160, sixth dipole antenna 170, seventh dipole antenna 180, and eighth dipole antenna 190. The first director 301, the second director 302, the third director 303, and the fourth director 304 are configured to guide the high-frequency radiation outwardly, so as to enhance the radiation pattern of the antenna system 300 operating in the high-frequency band, without expanding the total area of the antenna system 300. Other features of the antenna system 300 of FIG. 6A, FIG. 6B, and FIG. 6C are similar to those of the antenna system 100 of FIG. 4A, FIG. 4B, and FIG. 4C. Accordingly, the two embodiments can achieve similar levels of performance.

Figure 7:
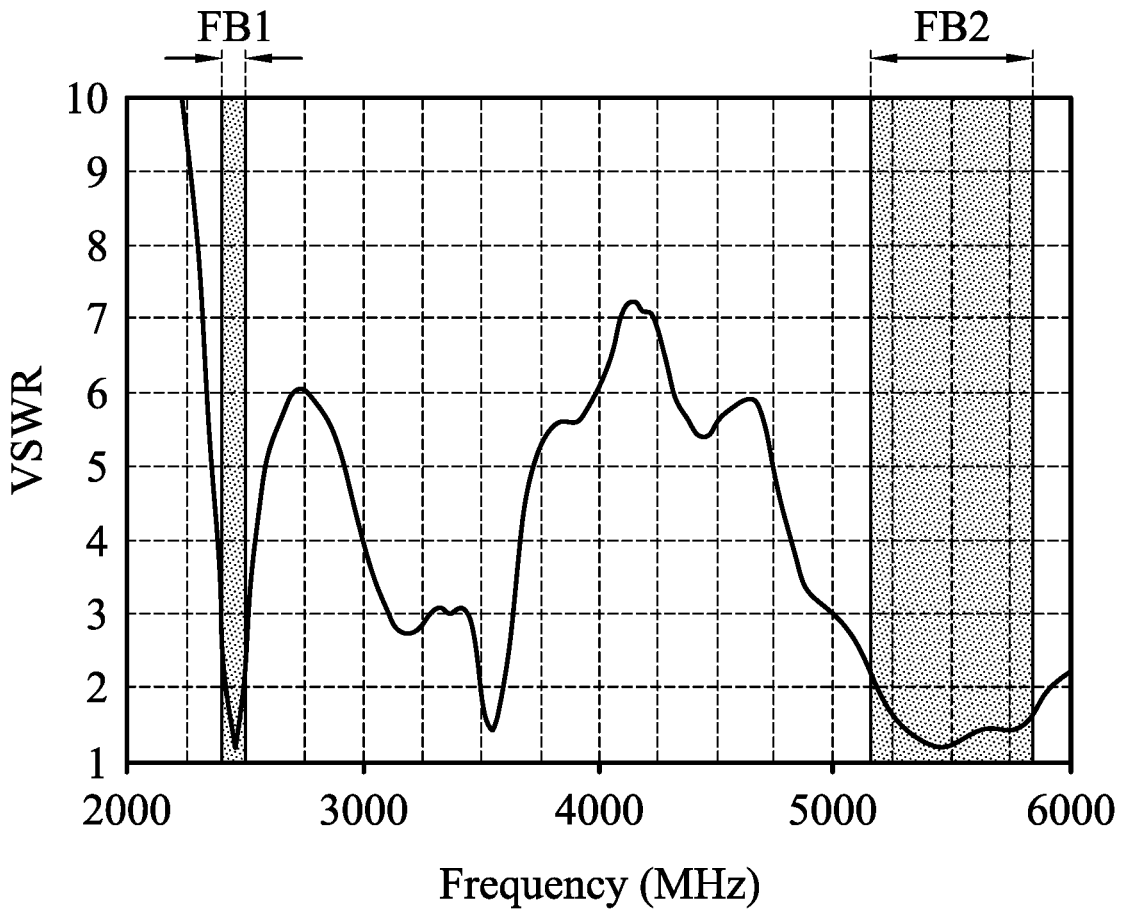
FIG. 7 is a diagram of voltage standing wave ratio (VSWR) of an antenna system according to an embodiment of the invention.

FIG. 7 is a diagram of voltage standing wave ratio (VSWR) of the antenna system 300 according to an embodiment of the invention, where the horizontal axis represents the operation frequency (MHz), and the vertical axis represents the VSWR. According to the measurement of FIG. 7, the antenna system 300 can at least cover a low-frequency band FB1 from about 2400 MHz to about 2500 MHz, and a high-frequency band FB2 from about 5150 MHz to about 5850 MHz. Therefore, the antenna system 300 can support at least the dual-band operations of WLAN (Wireless Local Area Network) 2.4 GHz/5 GHz.

Figure 8A:
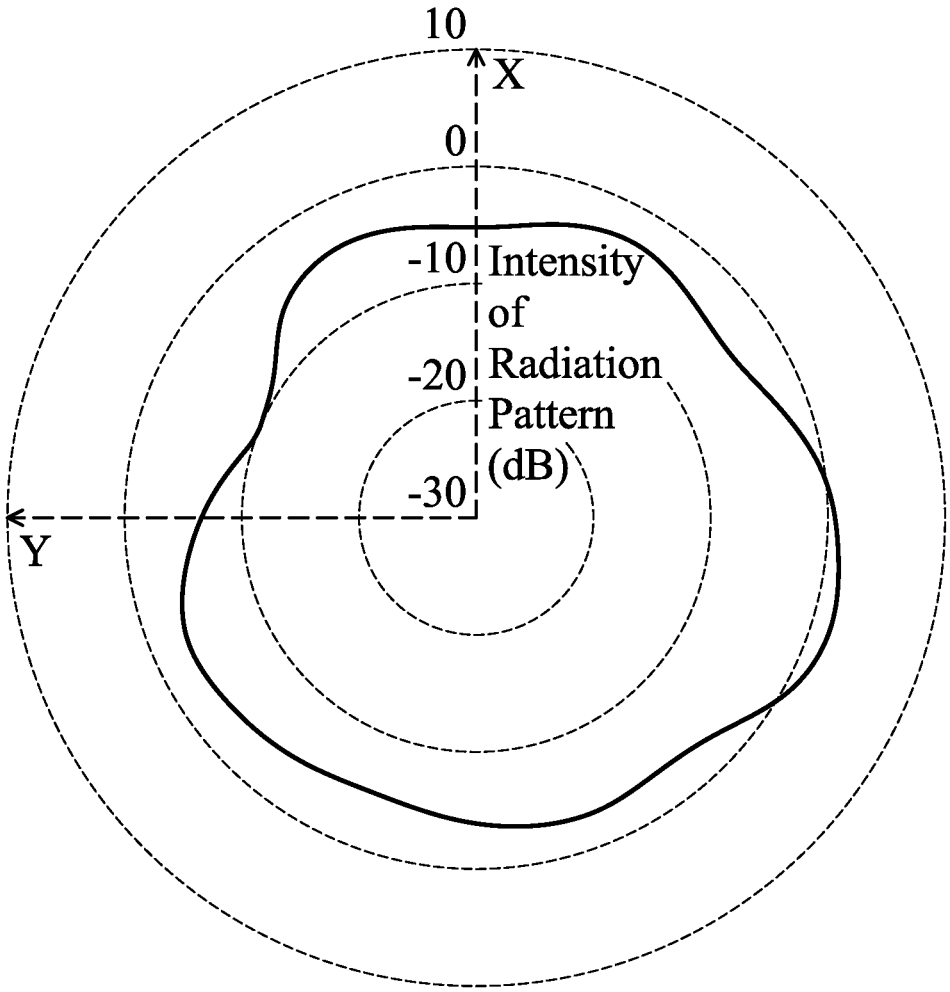
FIG. 8A is a radiation pattern of an antenna system operating in a low-frequency band according to an embodiment of the invention.
Figure 8B:
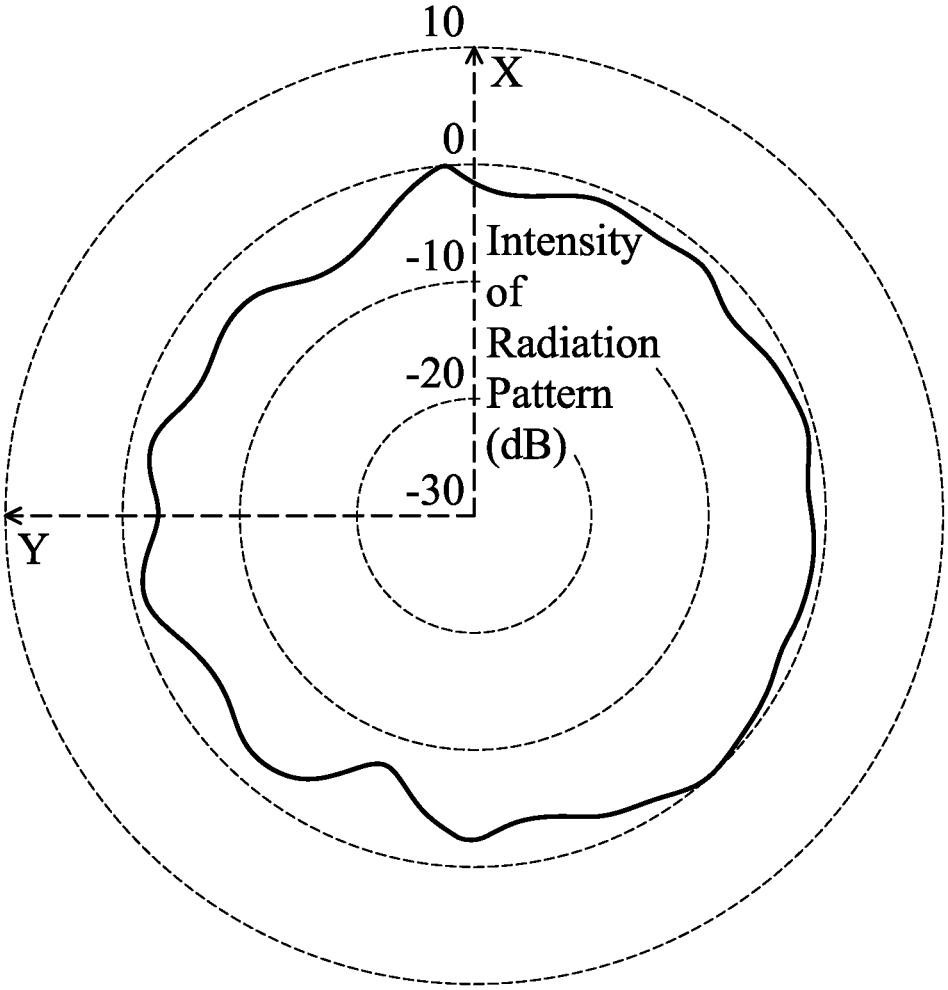
FIG. 8B is a radiation pattern of an antenna system operating in a high-frequency band according to an embodiment of the invention.

FIG. 8A is a radiation pattern of the antenna system 300 operating in the low-frequency band FB1 according to an embodiment of the invention, which is measured along the XY plane. FIG. 8B is a radiation pattern of the antenna system 300 operating in the high-frequency band FB2 according to an embodiment of the invention, which is measured along the XY plane. According to the measurement of FIG. 8A and FIG. 8B, the antenna system 300 is considered as an improved Alford loop antenna. With the miniaturized size, the antenna system 300 can still generate an almost omnidirectional radiation pattern in the desired high/low-frequency band, so as to meet the requirements for practical applications.

In some embodiments, the total length L1 of each of the first dipole antenna 120, the second dipole antenna 130, the third dipole antenna 140, and the fourth dipole antenna 150 is substantially equal to 0.5 wavelength (λ/2) of the low-frequency band FB1. The total length L2 of each of the fifth dipole antenna 160 (or 260), the seventh dipole antenna 170 (or 270), the seventh dipole antenna 180 (or 280), and the eighth dipole antenna 190 (or 290) is substantially equal to 0.5 wavelength (λ/2) of the high-frequency band FB2. In some embodiments, the element sizes of the antenna systems 100, 200, and 300 are estimated according to the following equations (1) to (6).

$$A = \frac{300}{\sqrt{2}\cdot\alpha\cdot\sqrt{C+1}} \tag{1}$$

$$B = \frac{300}{\sqrt{2}\cdot\beta\cdot\sqrt{C+1}} \tag{2}$$

where the parameters "A" and "B" are in units of millimeters (mm), the central frequency of the low-frequency band FB1 is set to "a" GHz, the central frequency of the high-frequency band FB2 is set to "β" GHz, and the dielectric constant of the dielectric substrate 105 is set to "C".

$$0.6 \cdot A < L1 < 1.4 \cdot A \quad (3)$$

where "L1" represents the total length of each of the first dipole antenna 120, the second dipole antenna 130, the third dipole antenna 140, and the fourth dipole antenna 150.

$$0.6 \cdot B < L2 < 1.4 \cdot B \quad (4)$$

where "L2" represents the total length of each of the fifth dipole antenna 160 (or 260), the seventh dipole antenna 170 (or 270), the seventh dipole antenna 180 (or 280), and the eighth dipole antenna 190 (or 290).

$$0.3 \cdot A < L3 < 0.7 \cdot A \quad (5)$$

where "L3" represents the total length of the vertical projection of each of the first transmission line 111, the second transmission line 112, the third transmission line 113, and the fourth transmission line 114.

$$0.3 \cdot B < D1 < 0.7 \cdot B \quad (6)$$

where "D1" represents the distance between the feeding point FP and each of the fifth dipole antenna 160 (or 260), the sixth dipole antenna 170 (or 270), the seventh dipole antenna 180 (or 280), and the eighth dipole antenna 190 (or 290).

In some embodiments, the distance D2 from each of the first director 301, the second director 302, the third director 303, and the fourth director 304 to a corresponding one of the fifth dipole antenna 160, the seventh dipole antenna 170, the seventh dipole antenna 180, and the eighth dipole antenna 190 is substantially equal to the aforementioned distance D1, and its estimation method has been described in equation (6). In alternative embodiments, the total length L4 of each of the first director 301, the second director 302, the third director 303, and the fourth director 304 is substantially from 0.4 to 1.1 times the total length L2 of each of the fifth dipole antenna 160, the seventh dipole antenna 170, the seventh dipole antenna 180, and the eighth dipole antenna 190 (i.e. $0.4 \cdot L2 < L4 < 1.1 \cdot L2$), and its estimation method has been described in equation (4). It should be noted that the element size ranges estimated by equations (1) to (6) are determined according to a lot of experiment results, and they are arranged for optimizing the operation band and impedance matching of the antenna systems 100, 200, and 300.

Figure 9:
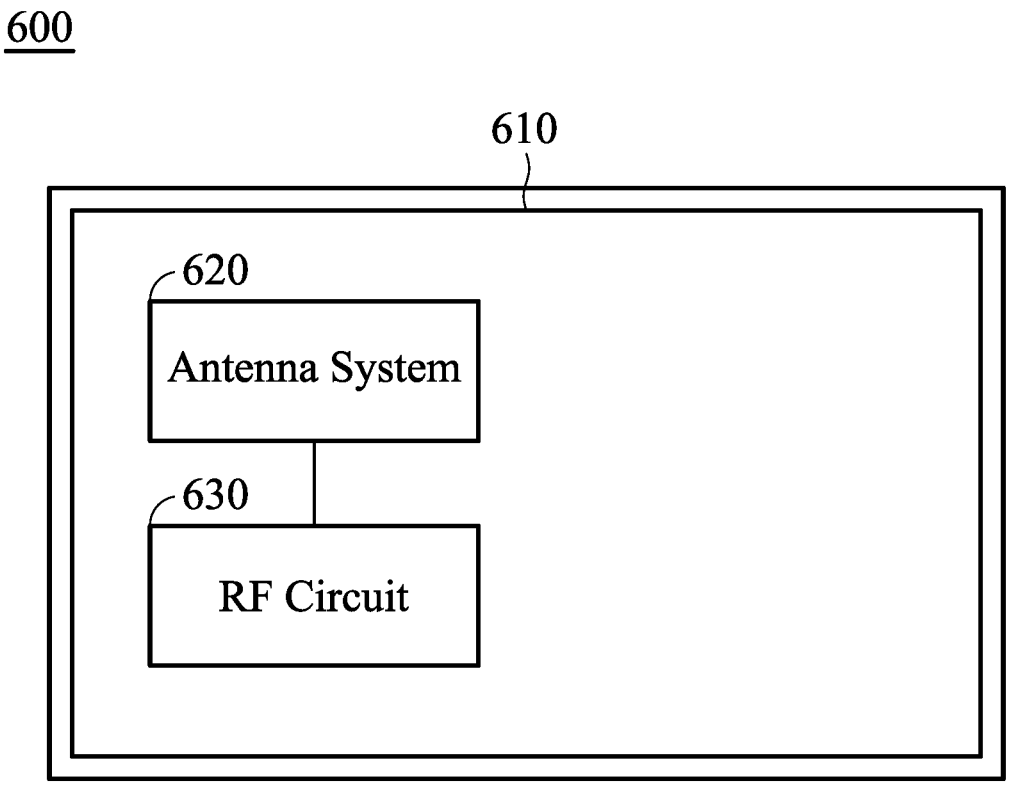
FIG. 9 is a diagram of a wireless access point according to an embodiment of the invention.

FIG. 9 is a diagram of a wireless access point 600 according to an embodiment of the invention. In the embodiment of FIG. 9, the wireless access point 600 includes a housing 610, an antenna system 620, and an RF circuit 630. The housing 610 may be a hollow structure of any shape. The antenna system 620 and the RF circuit 630 may be disposed in the housing 610. The antenna system 620 is electrically connected to the RF circuit 630. It should be noted that the antenna system 620 is any one selected among the aforementioned antenna systems 100, 200, and 300. The function and structure of the antenna system 620 have been described in the above embodiments.

The invention proposes a novel communication device. In comparison to the conventional design, the invention has at least the advantages of: (1) covering a wider frequency band, (2) providing an almost omnidirectional radiation pattern, (3) effectively reducing the total antenna size, (4) increasing the isolation between antenna elements, (5) having a simple structure to be easily manufactured, (6) reducing the total manufacturing cost, and (7) being applicable to a variety of environments without calibration. Therefore, the invention is suitable for application in a variety of multiband communication devices or wireless access points.

Note that the above element sizes, element shapes, and frequency ranges are not limitations of the invention. An antenna designer can fine-tune these settings or values according to different requirements. It should be understood that the communication device of the invention is not limited to the configurations of FIGS. 1-9. The invention may merely include any one or more features of any one or more embodiments of FIGS. 1-9. In other words, not all of the features displayed in the figures should be implemented in the communication device of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A communication device, comprising:

a first antenna group, comprising:
- a first antenna element;
- a second antenna element, disposed opposite to the first antenna element;
- a third antenna element; and
- a fourth antenna element, disposed opposite to the third antenna element;

a second antenna group, comprising:
- a fifth antenna element;
- a sixth antenna element, disposed adjacent to the fifth antenna element;
- a seventh antenna element, disposed adjacent to the sixth antenna element and opposite to the fifth antenna element;
- an eighth antenna element, disposed adjacent to the fifth antenna element and the seventh antenna element and opposite to the sixth antenna element;
- a ninth antenna element;
- a tenth antenna element;
- an eleventh antenna element, disposed opposite to the ninth antenna element; and
- a twelfth antenna element, disposed opposite to the tenth antenna element, wherein the fifth antenna element, the sixth antenna element, the seventh antenna element, and the eighth antenna element are interleaved with the ninth antenna element, the tenth antenna element, the eleventh antenna element, and the twelfth antenna element; and a metal partition plane, positioned between the first antenna group and the second antenna group;

wherein each of the first antenna element, the second antenna element, the fifth antenna element, the sixth antenna element, the seventh antenna element, and the eighth antenna element has a first polarization direction;

wherein each of the third antenna element, the fourth antenna element, the ninth antenna element, the tenth antenna element, the eleventh antenna element, and the twelfth antenna element has a second polarization direction;

wherein the second polarization direction is different from the first polarization direction.

2. The communication device as claimed in claim 1, wherein the second polarization direction is perpendicular to the first polarization direction.

3. The communication device as claimed in claim 1, wherein the first polarization direction is parallel to the metal partition plane, and the second polarization direction is perpendicular to the metal partition plane.

4. The communication device as claimed in claim 1, wherein the first antenna group covers a first frequency band from 2400 MHz to 2500 MHz, and a second frequency band from 5150 MHz to 5850 MHz.

5. The communication device as claimed in claim 1, wherein the second antenna group covers a second frequency band from 5150 MHz to 5850 MHz.

6. The communication device as claimed in claim 1, wherein the first antenna element and the second antenna element are interleaved with the third antenna element and the fourth antenna element.

7. The communication device as claimed in claim 4, wherein a length of the metal partition plane is longer than or equal to 0.5 wavelength of the lowest frequency of the first frequency band.

8. The communication device as claimed in claim 4, wherein a distance between the first antenna element and the second antenna element is longer than or equal to 0.125 wavelength of the lowest frequency of the first frequency band.

9. The communication device as claimed in claim 4, wherein a distance between the third antenna element and the fourth antenna element is longer than or equal to 0.25 wavelength of the lowest frequency of the first frequency band.

10. The communication device as claimed in claim 4, wherein a distance between any adjacent two of the fifth antenna element, the sixth antenna element, the seventh antenna element, and the eighth antenna element is longer than or equal to 0.125 wavelength of the lowest frequency of the second frequency band.

11. The communication device as claimed in claim 4, wherein a distance between any adjacent two of the ninth antenna element, the tenth antenna element, the eleventh antenna element, and the twelfth antenna element is longer than or equal to 0.25 wavelength of the lowest frequency of the second frequency band.

12. The communication device as claimed in claim 4, wherein a distance between the metal partition plane and each of the first antenna element, the second antenna element, the fifth antenna element, the sixth antenna element, the seventh antenna element, and the eighth antenna element is longer than or equal to 0.125 wavelength of the highest frequency of the second frequency band.

13. The communication device as claimed in claim 4, wherein the third antenna element and the fourth antenna element have a first vertical projection on the metal partition plane, wherein the ninth antenna element, the tenth antenna element, the eleventh antenna element, and the twelfth antenna element have a second vertical projection on the metal partition plane, and wherein the second vertical projection at least partially overlaps the first vertical projection.

14. The communication device as claimed in claim 13, wherein there is a first distance between the metal partition plane and each of the third antenna element and the fourth antenna element, there is a second distance between the metal partition plane and each of the ninth antenna element, the tenth antenna element, the eleventh antenna element, and the twelfth antenna element, and a sum of the first distance and the second distance is longer than or equal to 1 wavelength of the lowest frequency of the second frequency band.

15. The communication device as claimed in claim 4, wherein the third antenna element and the fourth antenna element have a first vertical projection on the metal partition plane, wherein the ninth antenna element, the tenth antenna element, the eleventh antenna element, and the twelfth antenna element have a second vertical projection on the metal partition plane, and wherein the second vertical projection does not overlap the first vertical projection at all.

16. The communication device as claimed in claim 15, wherein there is a first distance between the metal partition plane and each of the third antenna element and the fourth antenna element, there is a second distance between the metal partition plane and each of the ninth antenna element, the tenth antenna element, the eleventh antenna element, and the twelfth antenna element, and a sum of the first distance and the second distance is longer than or equal to 0.5 wavelength of the lowest frequency of the second frequency band.

17. The communication device as claimed in claim 15, wherein the metal partition plane has one or more slots.

18. The communication device as claimed in claim 17, wherein a length of each of the slots is equal to 0.25 wavelength of the lowest frequency of the second frequency band.

19. The communication device as claimed in claim 1, further comprising:

a metal reflective plane, wherein the second antenna group is positioned between the metal partition plane and the metal reflective plane.

* * * * *